US006471556B1

(12) United States Patent
Yamashita et al.

(10) Patent No.: US 6,471,556 B1
(45) Date of Patent: Oct. 29, 2002

(54) TILTING MECHANISM FOR OUTBOARD MOTOR

(75) Inventors: Ryuji Yamashita; Takahiro Fukuda; Tomonao Kitahara, all of Katsuta-gun; Tatsumi Uchida, Yokohama, all of (JP)

(73) Assignees: Unikas Industrial Inc., Okayama-Ken (JP); NHK Morse Co., Ltd., Kanagawa-Ken (JP)

( * ) Notice: Subject to any disclaimer, the term of this patent is extended or adjusted under 35 U.S.C. 154(b) by 0 days.

(21) Appl. No.: 10/109,807

(22) Filed: Mar. 28, 2002

(51) Int. Cl.[7] ..... B63H 20/12
(52) U.S. Cl. ..... 440/61; 114/150
(58) Field of Search ..... 440/53, 61; 114/144 R, 114/150

(56) References Cited

U.S. PATENT DOCUMENTS

| | | | | |
|---|---|---|---|---|
| 3,718,110 A | * | 2/1973 | Blanchard | 440/61 |
| 4,666,410 A | * | 5/1987 | Anselm | 440/61 |
| 6,276,977 B1 | | 8/2001 | Treinen et al. | |

* cited by examiner

*Primary Examiner*—Ed Swinehart
(74) *Attorney, Agent, or Firm*—Merchant & Gould P.C.

(57) ABSTRACT

A mechanism for tilting an outboard motor. The mechanism has an outboard motor which is attached to a hull so as to be tilted up and down, a cylinder for driving the outboard motor to change a posture of the outboard motor, and a linkage to connect the outboard motor and a rod of the cylinder. The cylinder itself serves as a central shaft, around which the outboard motor is tilted up and down. Since the cylinder has a single-walled construction, the mechanism of the present invention is simple and can be economically manufactured.

3 Claims, 9 Drawing Sheets

TILTING MECHANISM FOR OUTBOARD MOTOR

BACKGROUND OF THE INVENTION

1. Field of the Invention

The present invention relates to a tilting mechanism for an outboard motor.

2. Description of the Related Art

FIG. 1 exemplifies a conventional outboard motor, which is attached to a rear portion of a hull of a small-type cruiser, such as a pleasure boat.

The outboard motor 1 is connected to the hull 10 via a bracket 2. When the outboard motor 1 is tilted up, it rotates upward together with a supporting rod 3 as a rotating axis. In this arrangement, the supporting rod 3 itself rotates around its central axis. At the both ends of the supporting rod 3, cylinder-support arms 4 are provided. A piston rod 5 is provided so as to connect two cylinder-support arms 4.

Almost at the center of the piston rod 5, a piston (not shown) is fixed, and a cylinder tube 6 is placed outside of the piston. Thus, there are provided two piston rooms (or, cylinder rooms) at the both sides of the piston in the cylinder tube 6. Working fluid, such as working oil, is supplied into the piston rooms inside the cylinder tube 6 from a hydraulic hose 12, so that the cylinder tube 6 moves to the right and left, as shown by an arrow in FIG. 1.

The outboard motor 1 is connected to the cylinder tube 6 via a linkage 8. Thus, along with the movement of the cylinder tube 6 to the right and left, the steering of the outboard motor 1 can be controlled to change the navigating direction of the boat.

In the prior art shown in FIG. 1, when the outboard motor 1 is tilted up or down, the cylinder tube 6 also swings up and down around the supporting rod 3. In the case that the cylinder tube 6 swings along with the tilting movement of the outboard motor 1, the hydraulic hose 12 itself also swings therewith. This may interfere with the hose arrangement, and depending on the situation, the tilting movement of the outboard motor 1 itself is also prevented.

As another prior art for avoiding the above-mentioned inconvenience, a construction shown in FIG. 2 is known. In FIG. 2, an outboard motor is schematically shown from right above.

In the construction in FIG. 2, the outboard motor is to be tilted up around a tilt tube 21. A connecting rod 23 is connected straight to a piston rod of a cylinder 22, which is intended for controlling the steering of the outboard motor. The connecting rod 23 extends through the tilt tube 21, and is connected to the outboard motor via a linkage 24 and a metal fitting 25. Thus, the steering of the outboard motor can be controlled with the cylinder 22.

In this prior art, the cylinder 22 is aligned co-axially with the tilt tube 21, and therefore, the problem as to the hose arrangement can be avoided. But, as can be understood from FIG. 2, the overall width of the equipment becomes large, and depending on the transom space (a space on a hull for fixing an outboard motor), the fixation itself of the outboard motor may be difficult.

Further, U.S. Pat. No. 6,276,977, issued to Treinen et al., discloses a construction wherein a cylinder member of an actuator is co-axially arranged with a rotation axis around which an outboard motor rotates, wherein the cylinder member is double-walled construction.

FIGS. 3 to 5 exemplify such a double-walled construction, wherein a one-sided rod relative to a piston is employed. By the way, FIG. 3 corresponds to FIG. 2.

In FIG. 3, a cylinder 30 serves as a shaft for tilting movement of an outboard motor. A linkage 60 is connected to a rod 31 extending from one end of the cylinder 30. The linkage 60 is connected to the outboard motor via a metal fitting 61. When the cylinder rod 31 moves to the right and left in FIG. 3, the outboard motor rotates around a point "A", as shown by an arrow, to change its posture. Thus, the navigating direction of the boat can be controlled. Working fluid is supplied from a hydraulic hose (not shown), via tee joints 65, 66, to a first port 41*a* and a second port 42*a*, which will be explained later.

FIG. 4 shows a sectional view of the cylinder mechanism of FIG. 3. With reference to FIG. 4, an outer tube 50 is pressingly fitted into a bore which is formed on a structural portion 1' extending from the outboard motor. When the outboard motor is tilted up, the outer tube 50 rotates therewith around its central axis on both sides of the structural portion 1', attachment brackets 2 extend from the outboard motor to the hull. The brackets 2 are immobilized, even when the outboard motor is tilted up. Thus, when the outboard motor is tilted up, the outer tube 50 is rotated with sliding movement relative to the brackets 2. It is to be noted that the outer tube 50 is connected to the brackets 2, via bushes 51.

A piston 32 is fixed to one end of the cylinder rod 31, and an inner tube 40 extends outside the piston 32 with contacting the outer circumference of the piston 32. Thus, two cylinder rooms 41, 42 (a first room 41 and a second room 42) are formed on both sides of the piston 32. The outer tube 50 is arranged outside the inner tube so as to be co-axially aligned with the inner tube 40. As shown in FIG. 5, a space 'S' having a predetermined width is kept between the outer tube 50 and the inner tube 40. This space 'S' serves as a channel for supplying fluid to the cylinder room 42, as explained below.

The first port 41a for supplying working fluid to the cylinder room 41 is arranged on an end cover 35 at the left side of the cylinder. The second port 42*a* for supplying working fluid to the cylinder room 42 is also arranged on the end cover 35. That is, the first and the second ports 41*a*, 42*a* are both arranged on the same one end of the cylinder 30. Although the both ports are arranged on the left end of the cylinder 30 in FIG. 4, they can be arranged on the right end thereof, of course.

The working fluid from the first port 41*a* passes through a channel 41*b* into the cylinder room 41. On the other hand, the working fluid from the second port 42*a* passes through a channel 42*b* into the space 'S', then it moves up to the right end in the space 'S', and it turns into the cylinder room 42. This is shown in FIG. 5. FIG. 5 is an enlarged sectional view, which corresponds to the region inside the circle in FIG. 4.

In the above-mentioned double-walled construction, both of the tee joints 65, 66 can be arranged on one end of the cylinder, so that the hose arrangement can be simple, and the outward appearance can also be simple.

Further, since two tee joints 65, 66 can be arranged on one end of the cylinder, locating one end of the cylinder inside the hull would bring a benefit that its hose system does not appear on exterior of the hull. In such a constitution, not only the exterior of the hull can be smart, but also the hose system inside the hull can be protected from sea breeze, so that corrosion can be avoided to improve the durability.

FIGS. 6 and 7 exemplify another conventional double-walled construction. By the way, FIG. 6 corresponds to FIG. 4. That is, FIG. 6 is a sectional view showing the double-walled construction. Although, in the double-walled construction shown in FIGS. 3 to 5, only one end of the cylinder rod 31 extends outward from the cylinder 30, both ends of the cylinder rod extend outward from the both ends of the cylinder in FIG. 6.

In FIG. 6, the piston 32 is fixed to center of the cylinder rod 31 rather than the end of the cylinder. A rod portion 31*a* passes through the cylinder room 41 to outside of the cylinder, and a rod portion 31*b* passes through the cylinder room 42 to outside of the cylinder. FIG. 7 is an enlarged sectional view, which corresponds to the region inside the circle in FIG. 6. As shown in this enlarged view, the working fluid from the port 41*a* passes through a channel 41*c* into the cylinder room 41. The channel 41*c* is annular and extends around the rod portion 31*a*.

In the one-sided-rod-type cylinder in FIG. 4, although the rod 31 exists in the second cylinder room 42, in the first cylinder room 41 no rod exists. Therefore, the volume of the left cylinder room 41 and that of the right cylinder room 42 become different to each other, so that the moving rate of the rod with a volume of the working fluid becomes different, depending on the rod moving to the right or left. As a result, the response to the steering operation becomes different, depending on the rightward turn or leftward turn. This sometimes gives an operator a sense of incongruity.

Contrary to this, with the both-sided-rod-type cylinder, there is no difference in steering response, and in this respect, such the construction is superior to the one-sided-rod-type. But, the one-sided-rod-type cylinder is superior to the both-sided-rod-type cylinder, in respect that the whole apparatus can become compact. The rod extending from the cylinder is to be connected to the outboard motor via a linkage. The linkage can be provided on one end of the cylinder rod, or both ends of the cylinder.

However, the above-mentioned double-walled constructions have the disadvantage that the construction of the double-walled cylinder is very complicated and is relatively expensive to manufacture.

SUMMARY OF THE INVENTION

Therefore, an object of the present invention is to provide a tilting mechanism for an outboard motor, with which the tilting movement of the outboard motor is smooth, and with which the overall width of the tilting mechanism does not become superfluously large. Further, the tilting mechanism of the present invention has a relatively simple construction and can be economically manufactured.

In order to achieve the object of the present invention, there is provided a tilting mechanism for an outboard motor, comprising: an outboard motor which is attached to a hull so that the outboard motor can be tilted up and down; a cylinder for driving the outboard motor to change a posture of the outboard motor, the cylinder itself serving as a shaft about which the outboard motor can be tilted up and down; and a linkage to connect the outboard motor and a rod of the cylinder to each other, wherein the cylinder is single-walled, so that the cylinder comprises a tube which extends outside a piston fixed to the rod, and which contacts with an outer surface of the piston to form a first room and a second room on both sides of the piston, and wherein a first port supplying working fluid to the first room is located on one of ends of the cylinder near the first room, and a second port supplying working fluid to the second room is located on the other of the ends of the cylinder near the second room.

With the tilting mechanism constructed as above, when the outboard motor is tilted up and down, the cylinder only rotates about its central axis and does not change its location. Therefore, the disadvantage that the cylinder itself swings to interfere the hose arrangement, which has been found in the conventional construction in FIG. 1, is avoided.

Further, there is no need of a tilt tube 21, which has been required in the conventional construction in FIG. 2, and therefore the overall width of the apparatus can be minimized. Thus, the construction of the present invention is advantageous in view of space saving.

Further, since the cylinder is single-walled, the construction is simple and can be manufactured economically.

BRIEF DESCRIPTION OF THE DRAWINGS

This and other objects and features of the present invention will become apparent from the following description taken in conjunction with the preferred embodiments thereof with reference to the accompanying drawings.

DETAILED DESCRIPTION OF THE PREFERRED EMBODIMENT

Figure 1:
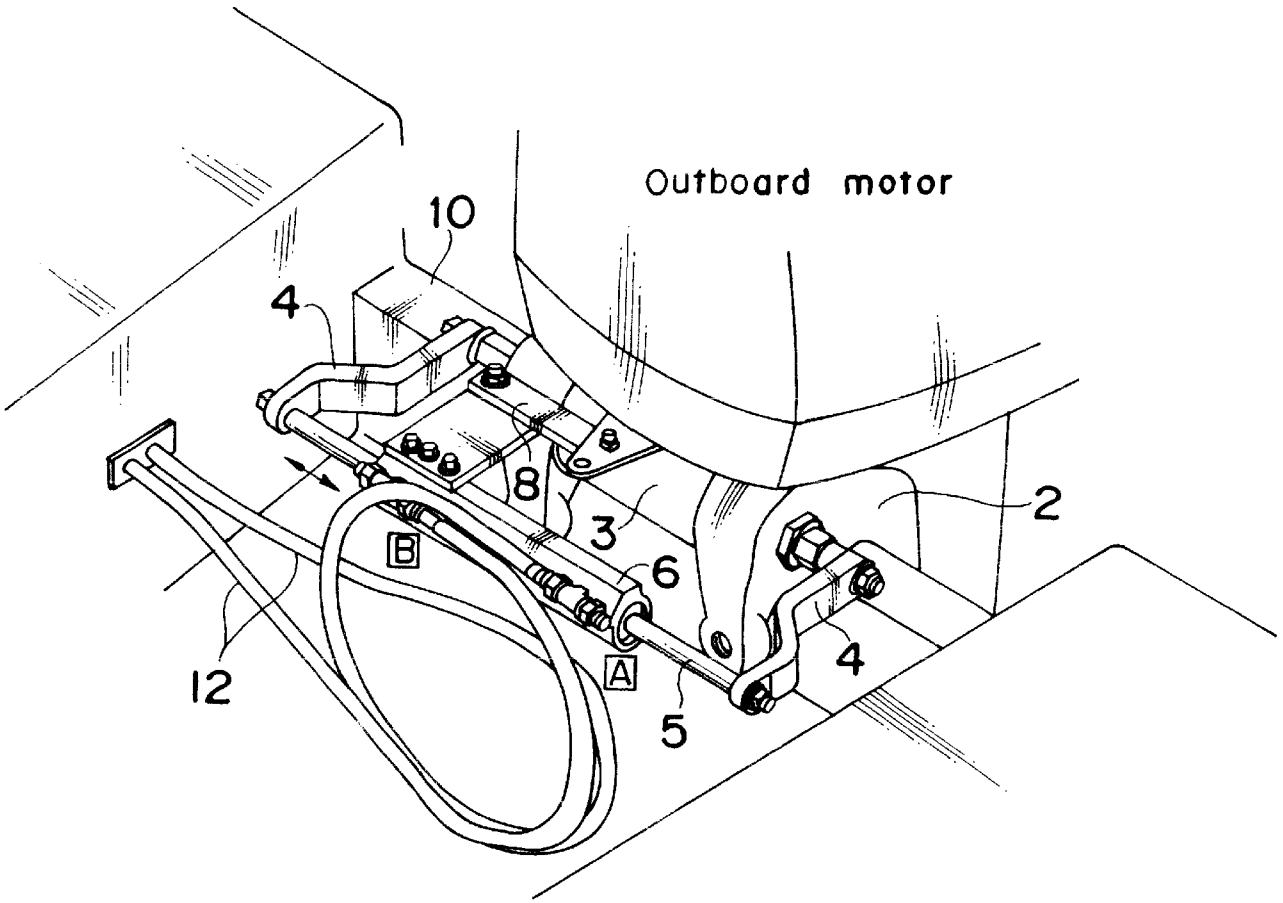
Fig. 1 PRIOR ART
FIG. 1 is a perspective schematic view showing a conventional tilting mechanism for an outboard motor.
Figure 2:
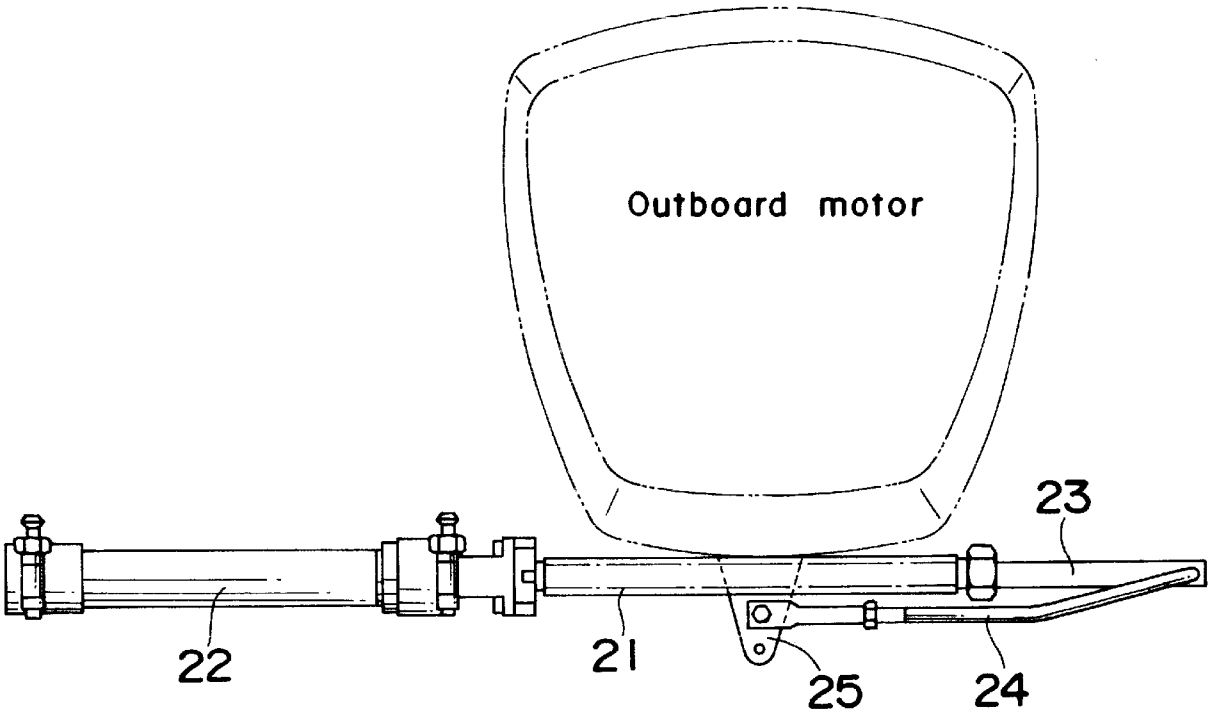
Fig. 2 PRIOR ART
FIG. 2 is a schematic view showing another conventional tilting mechanism.
Figure 3:
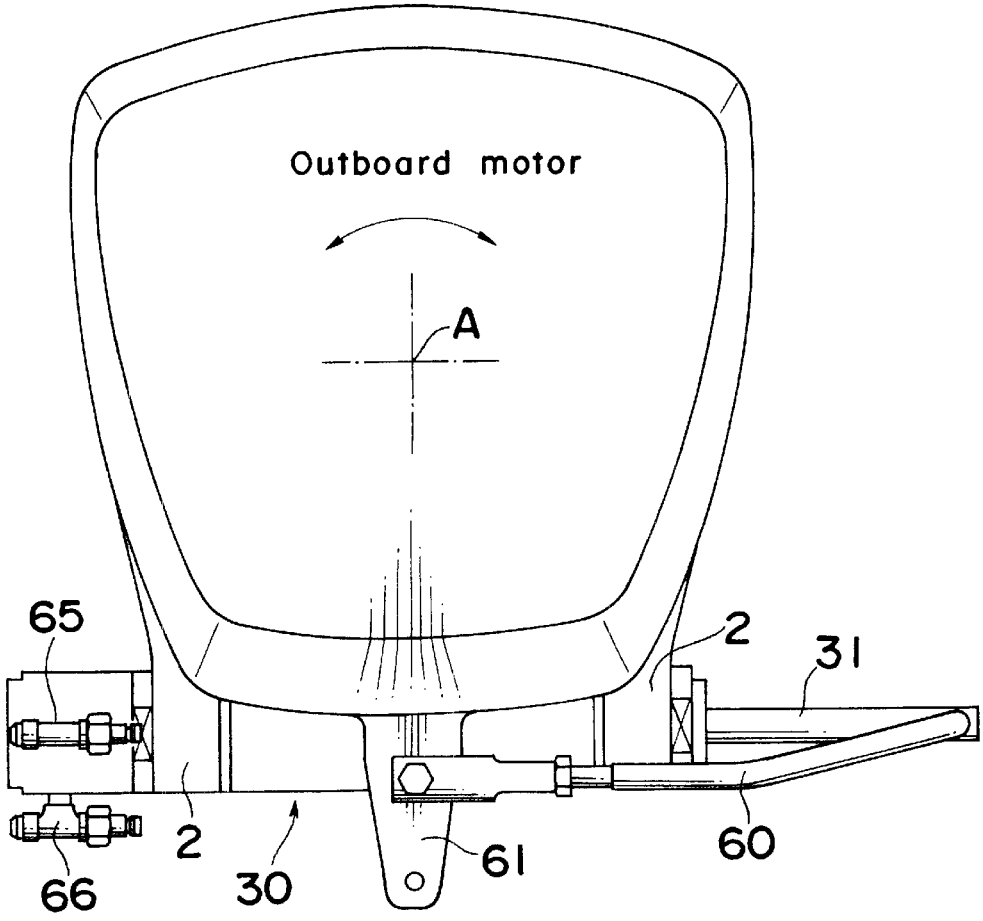
Fig. 3 PRIOR ART
FIG. 3 is a schematic view showing another conventional tilting mechanism of double-walled and one-sided-rod construction.

Before a description of the embodiments proceed, it is to be noted that like or corresponding parts are designed by like reference numerals throughout the accompanying drawings.

Figure 8:
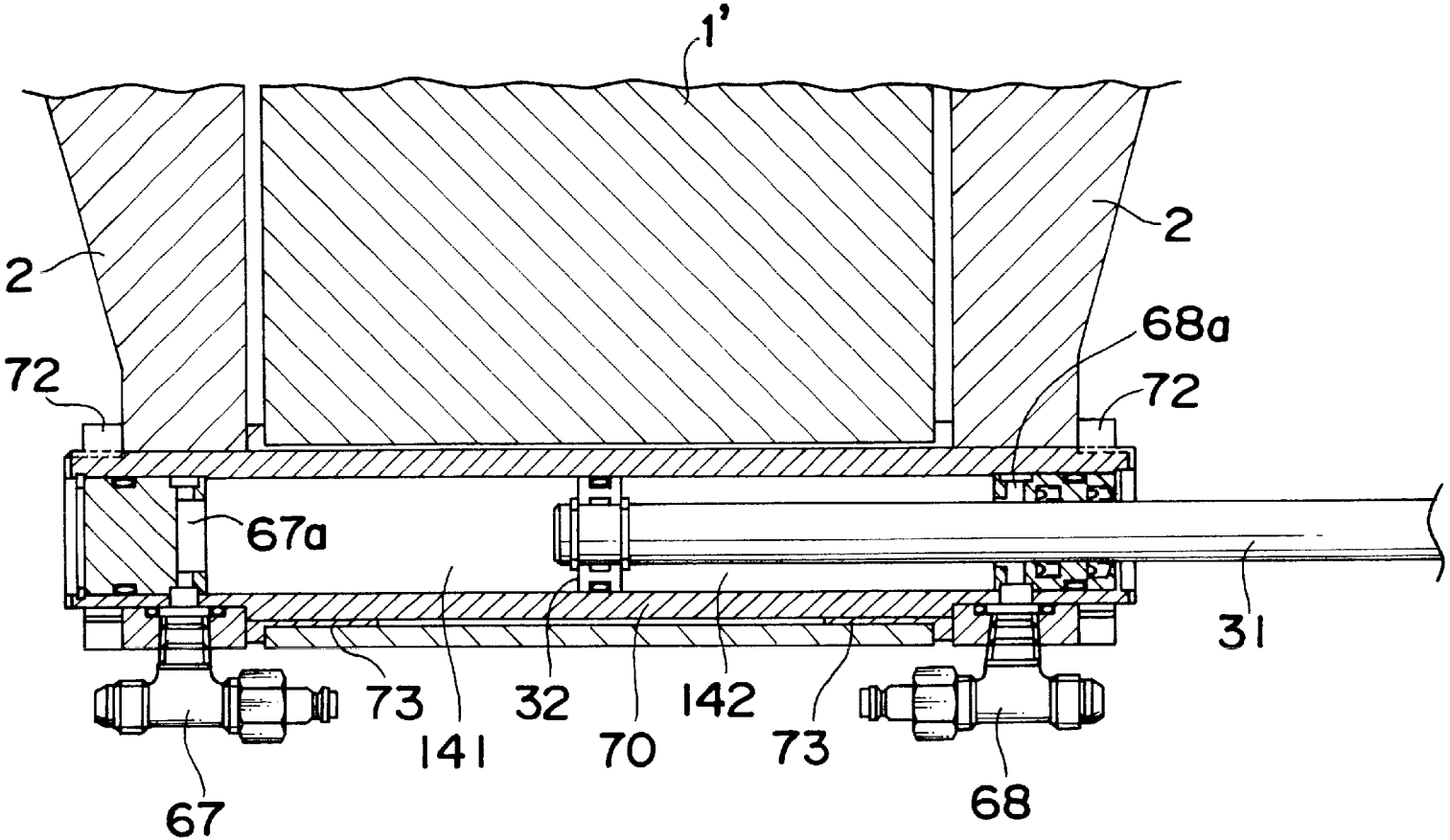
FIG. 8 is a sectional view of the cylinder portion in the tilting mechanism according to a first embodiment of the present invention.
Figure 9:
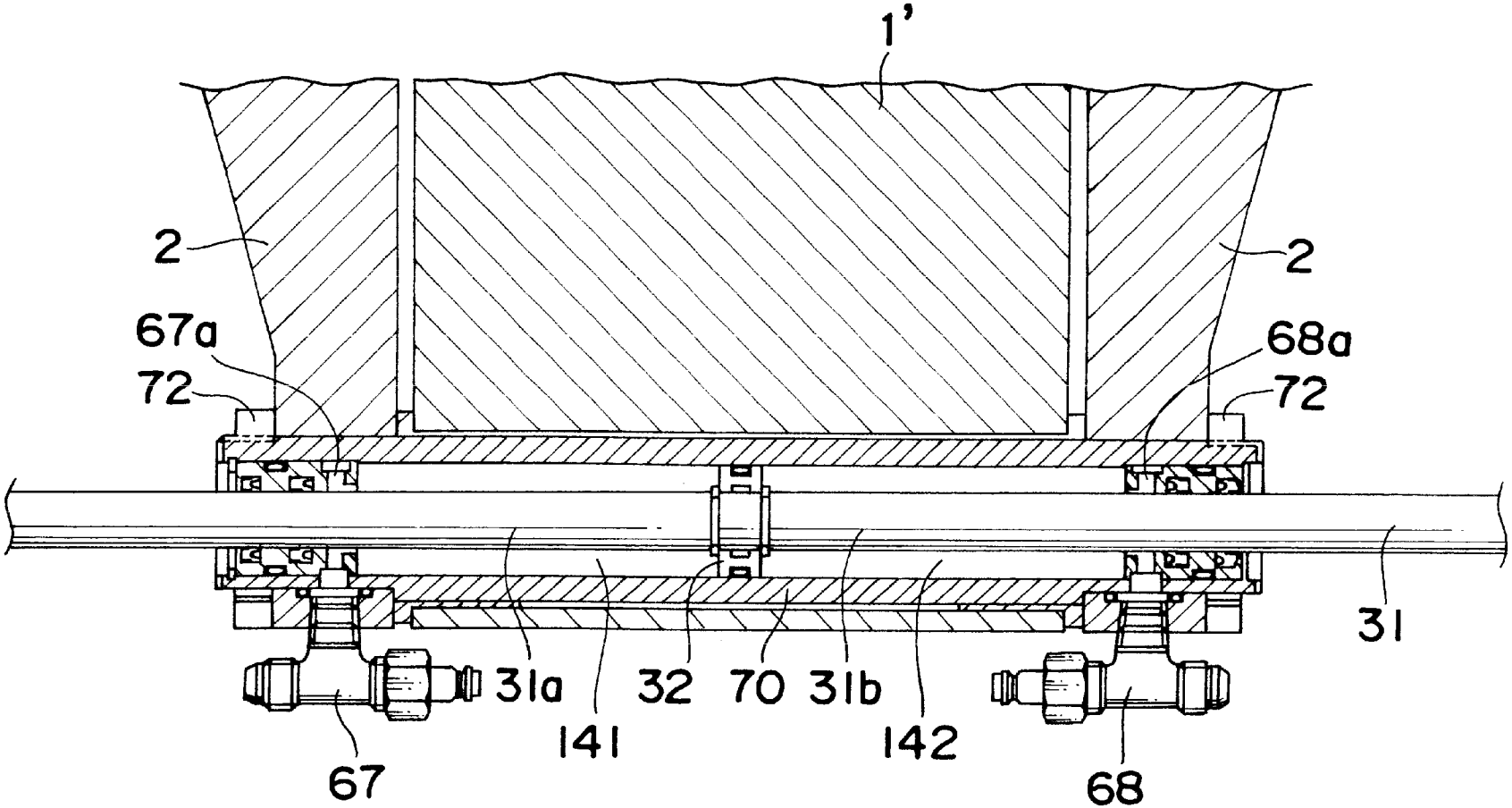
FIG. 9 is a sectional view of the cylinder portion in the tilting mechanism according to a second embodiment of the present invention.

Referring to FIGS. 8 and 9, the description is made below on a tilting mechanism for an outboard motor, according to each of the embodiments of the present invention.

Figure 4:
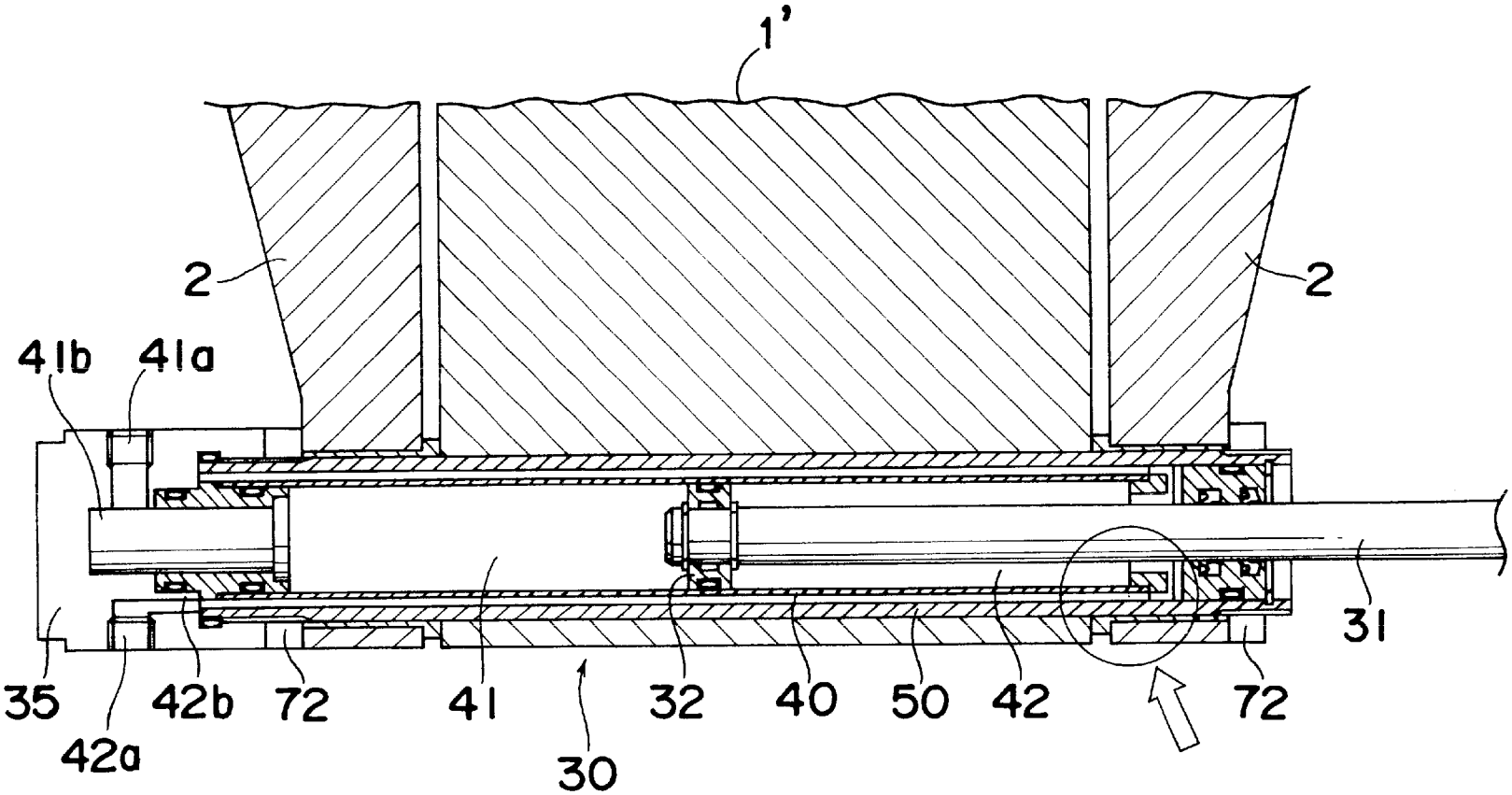
Fig. 4 PRIOR ART
FIG. 4 is a sectional view of a cylinder portion in the tilting mechanism in FIG. 3.
Figure 5:
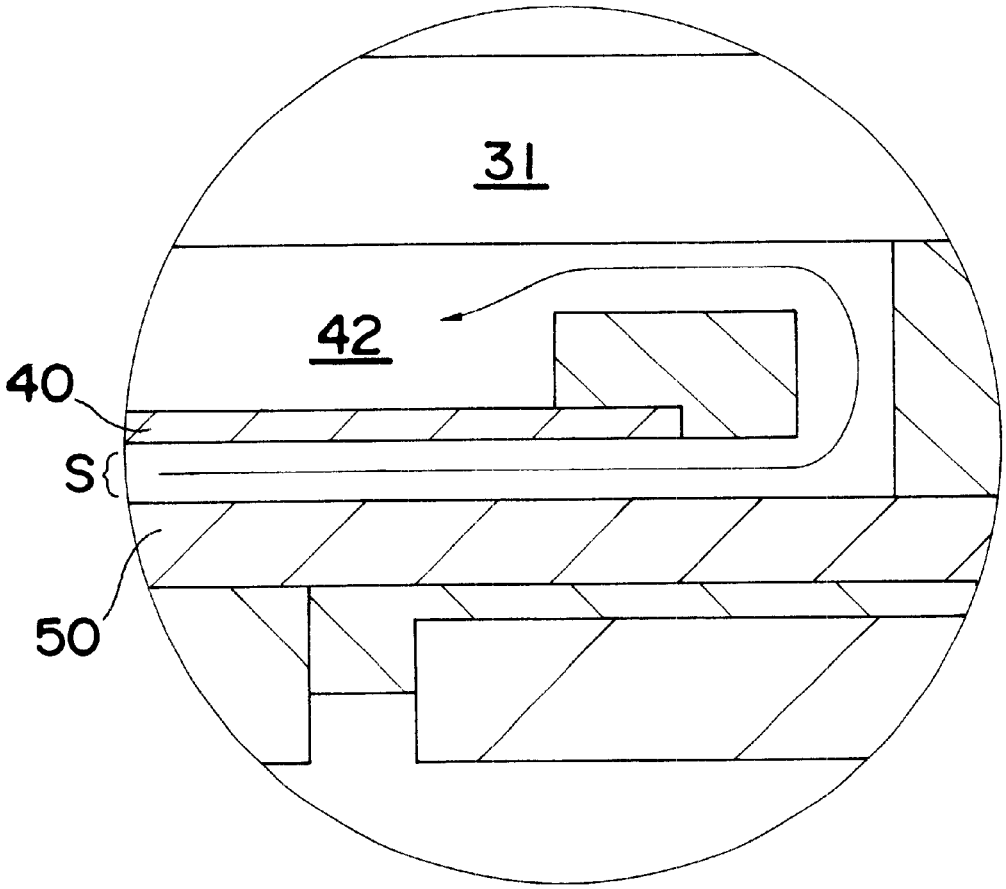
Fig.5 PRIOR ART
FIG. 5 is an enlarged sectional view, which corresponds to a region inside a circle in FIG. 4.
Figure 6:
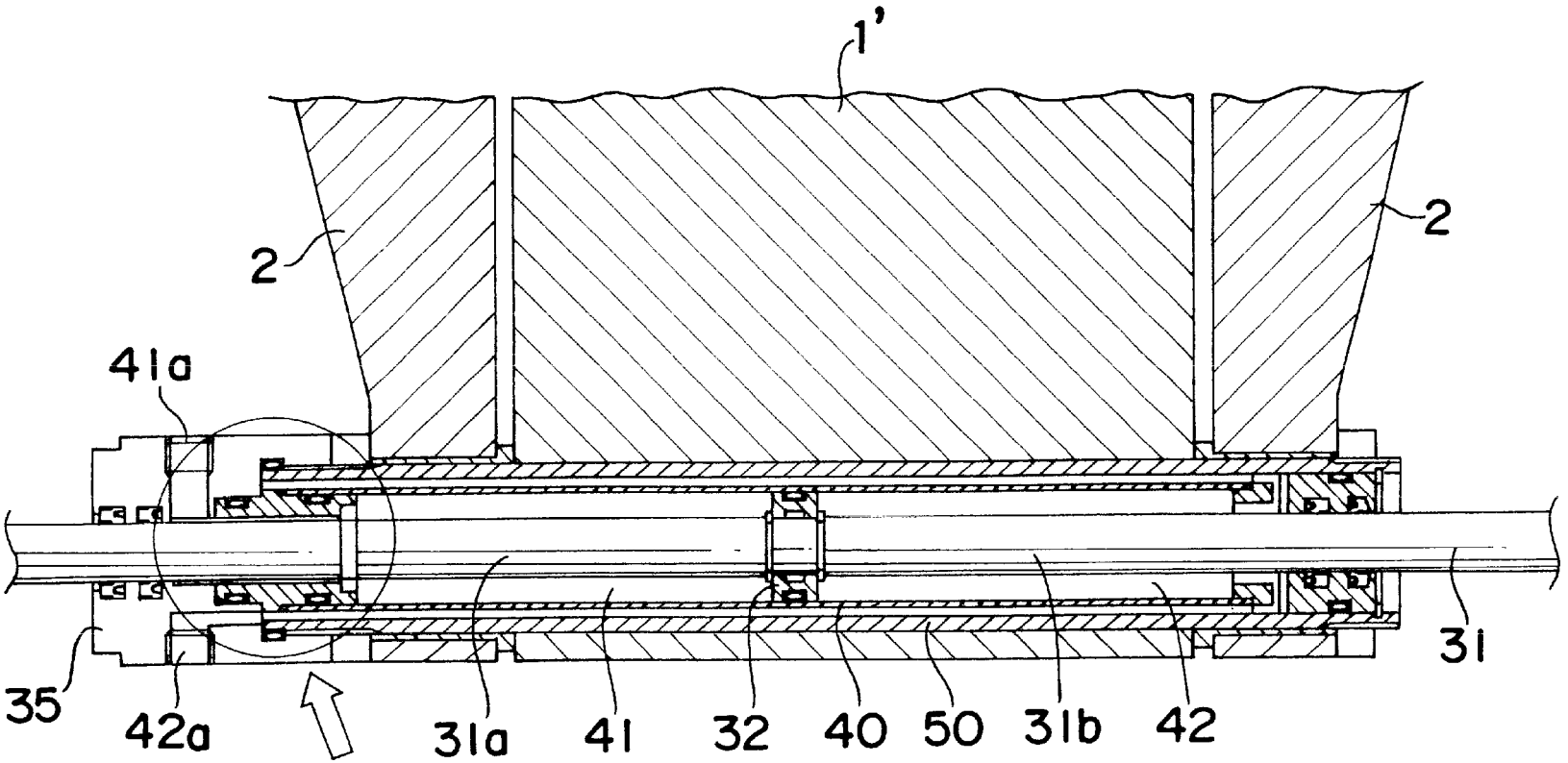
Fig. 6 PRIOR ART
FIG. 6 is a sectional view of the cylinder portion in another conventional tilting mechanism of double-walled an both-sided-rod construction.
Figure 7:
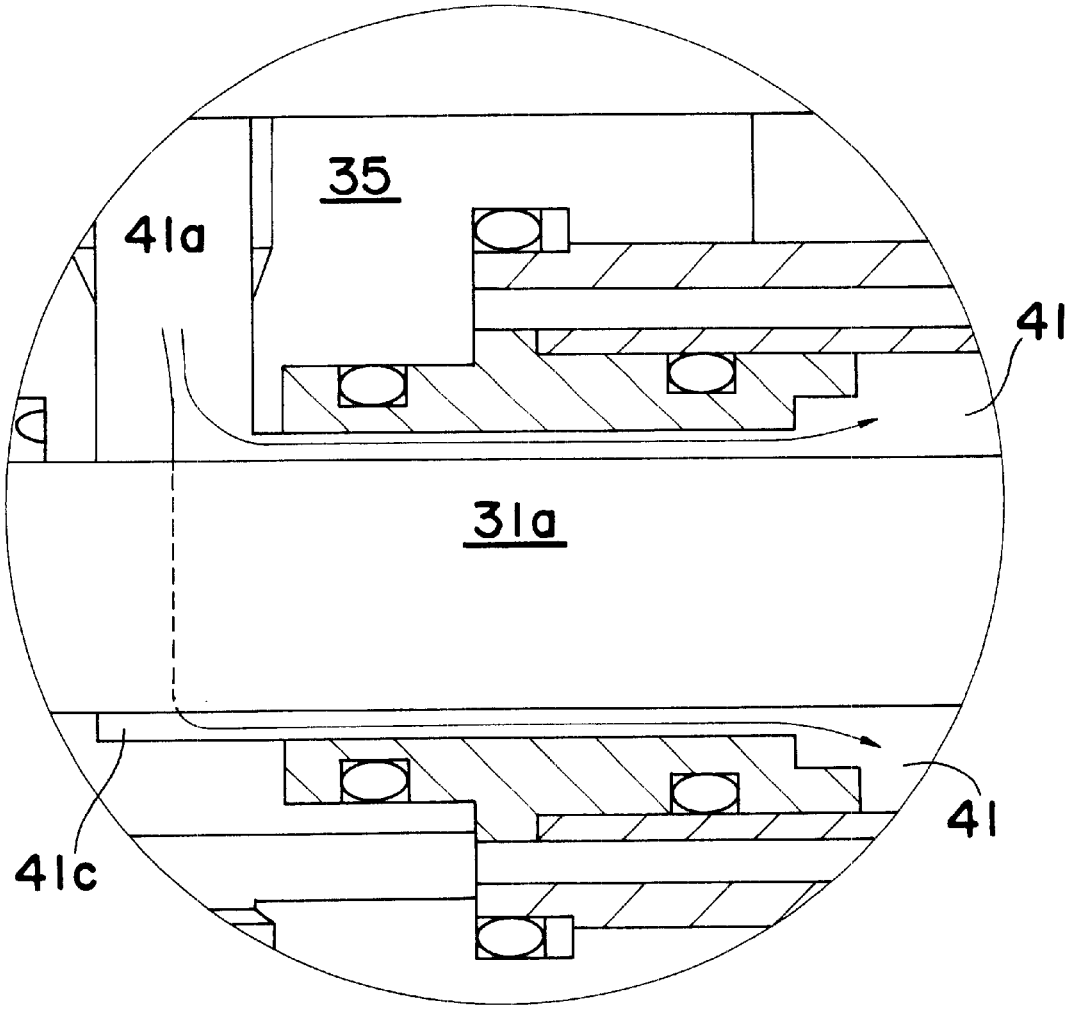
Fig. 7 PRIOR ART
FIG. 7 is an enlarged sectional view, which corresponds to a region inside a circle in FIG. 6.

FIG. 8 shows a tilting mechanism, according to the first embodiment of the present invention, which is of a type of a single-walled construction and of a one-sided rod relative to a piston. FIG. 8 corresponds to FIG. 4. The first embodiment is different from the conventional double-walled construction in FIGS. 3 to 7, in respect that the cylinder is of a single-walled type.

An outer tube 70 of the cylinder passes through a bore formed on the attachment bracket 2, and is fixed by lock nuts 72 at the both ends. That is, in this embodiment, even when the outboard motor is tilted up, the outer tube 70 does not rotate around its central axis, the outer tube 70 being stationary with the bracket 2. The outer tube 70 is supported by the structural portion 1' with bushes 73 being located therebetween. Therefore, when the outboard motor is tilted up, the structural portion 1' rotates with sliding movement on the outer tube 70.

In the case of the single-walled-type cylinder, one of two ports is located on one end of the cylinder and the other port is located on the other end of the cylinder. In the same way, one joint 67 is located on one end of the cylinder and the other joint 68 is located on the other end of the cylinder. The working fluid supplied from the hydraulic hose (not shown) via the tee joint 67 passes through the channel 67*a* into the cylinder room 141 (first room). Meanwhile, the working fluid supplied via the tee joint 68 passes through the channel 68*a* into the cylinder room 142 (second room).

In the conventional double-walled construction, both of two tee joints can be arranged on one end of the cylinder, and thus hydraulic hoses can advantageously arranged. To the contrary, in the present invention wherein the single-walled cylinder is employed, the construction of the cylinder can be simplified, and thus the low cost can be realized.

Next, with reference to FIG. 9, it is explained about the tilting mechanism, according to the second embodiment of the present invention, which is of a type of a single-walled construction and of a both-sided rod relative to a piston. FIG. 9 corresponds to FIG. 4.

In the first embodiment, only one end of the cylinder rod 31 extends outside of the cylinder, but in the second embodiment, both ends of the cylinder rod 31 extend outside of the cylinder.

In the second embodiment, like in the first embodiment, even when the outboard motor is tilted up, the outer tube 70 itself does not rotate, and it is stationary with the bracket 2. The structural portion 1' rotates with sliding movement relative to the outer tube 70.

The merits and demerits of the second embodiment with respect to the first embodiment employing the one-sided-rod-type cylinder are the same as those explained in the conventional double-walled constructions of one-sided-rod-type and both-sided-rod-type. That is, the both-sided-rod-type cylinder is superior in respect that the operator does not feel no sense of incongruity, and the one-sided-rod-type cylinder is superior in respect that the whole apparatus can be compact.

The merits and demerits of the second embodiment brought by employing the single-walled cylinder are the same as those explained in the first embodiment. That is, the conventional double-walled-type cylinder is superior in respect of the hose arrangements, and the single-walled-type cylinder of the present invention is superior in respect of the low cost.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A tilting mechanism for an outboard motor, comprising:

an outboard motor which is attached to a hull so that the outboard motor can be tilted up and down;

a cylinder for driving the outboard motor to change a posture of the outboard motor, the cylinder itself serving as a shaft about which the outboard motor can be tilted up and down; and a linkage to connect the outboard motor and a rod of the cylinder to each other, wherein the cylinder is single-walled, so that the cylinder comprises a tube which extends outside a piston fixed to the rod, and which contacts with an outer surface of the piston to form a first room and a second room on both sides of the piston, and wherein a first port supplying working fluid to the first room is located on one of ends of the cylinder near the first room, and a second port supplying working fluid to the second room is located on the other of the ends of the cylinder near the second room.

2. The tilting mechanism of claim 1, wherein both ends of the rod extend outside of the cylinder from both of the ends of the cylinder.

3. The tilting mechanism of claim 1, wherein only one end of the rod extends outside of the cylinder from one end of the cylinder.

* * * * *